US005398588A

United States Patent [19]

Peck

[11] Patent Number: 5,398,588

[45] Date of Patent: Mar. 21, 1995

[54] MISSILE SYSTEM WITH TELESCOPING LAUNCH TUBE

[75] Inventor: George E. Peck, Canoga Park, Calif.

[73] Assignee: Hughes Aircraft Company, Los Angeles, Calif.

[21] Appl. No.: 17,899

[22] Filed: Feb. 16, 1993

[51] Int. Cl.[6] ..... F41F 3/042

[52] U.S. Cl. ..... 89/1.806; 89/1.816

[58] Field of Search ..... 89/1.816, 1.817, 1.806, 89/1.7, 8

[56] References Cited

U.S. PATENT DOCUMENTS

| | | | |
|---|---|---|---|
| 3,015,991 | 1/1962 | Forbes | 89/1.7 |
| 3,745,876 | 7/1973 | Rocha | 89/1.816 |
| 3,859,890 | 1/1975 | Guthrie | 89/1.816 |
| 3,960,054 | 6/1976 | Looger | 89/1.816 |
| 4,038,903 | 8/1977 | Wohford | 89/8 |
| 4,376,405 | 3/1983 | Madderra | 89/1.816 |
| 4,393,745 | 7/1983 | Mayo et al. | 89/1.816 |
| 4,498,368 | 2/1985 | Doane | 89/1.817 |
| 4,616,554 | 10/1986 | Spink et al. | 89/1.806 |

*Primary Examiner*—David Brown

*Attorney, Agent, or Firm*—Randall M. Heald; Charles D. Brown; Wanda K. Denson-Low

[57] ABSTRACT

A missile launching system (18) for launching a missile (20) includes an automatically telescoping launch tube (22, 24) and a rest raining system (40, 42). The telescoping launch tube (22, 24) lengthens the period of guided travel of the missile (20) during launch, to improve its accuracy. The launch tube system has an outer case (24), and an inner launch tube (22) internally dimensioned to receive the missile (20) therein and externally dimensioned to slide within the outer case (24) from a rearward position to a forward position. The restraining system (40, 42) holds the missile (20) and inner launch tube (22) at the proper locations before and during firing, and includes a releasable holdback (40) for the inner launch tube (22) at the rearward position and a releasable holdback for the missile (20) at a preselected position within the inner launch tube (22). The inner launch tube (22) is restrained so that it may not slide past the forward position relative to the outer case (24) at the end of its travel during the launching sequence.

20 Claims, 4 Drawing Sheets

MISSILE SYSTEM WITH TELESCOPING LAUNCH TUBE

BACKGROUND OF THE INVENTION

This invention relates to missile system, and, more particularly, to a tube-launched missile.

Several types of missile systems may be carried by soldiers or: in light vehicles and used against tanks, aircraft, and other targets. In one common configuration, the missile is loaded into a launch tube, which is then aimed by the soldier at the target. When the missile propulsion motor is ignited, the missile accelerates down the length of the launch tube and leaves the launch tube for free flight to the target.

The launch tube plays an important role in the operability and accuracy of the missile system. The launch tube protects the missile prior to use, cushioning it against shocks that could damage its mechanism. When the missile is fired, the path of the missile is guided down the launch tube until the missile reaches a sufficient velocity that its own guidance and control functions become operable. At very low velocities the control fins of the missile are not effective in controlling the path of the missile, and the launch tube acts as the principal guidance device until the missile reaches the speed at which its own systems are effective.

Thus, on the one hand accuracy and control considerations call for a long launch tube, but on the other hand compactness and ease of storage and use call for a short launch tube. One solution to this problem of the selection of the length of the launch tube has been to use a sectional launch tube which can be assembled to an extended length by the user. In a variation, a manually telescoping launch tube has a compact, inwardly telescoped stored state. The launch tube is extended manually before launch by the user.

While operable, these various techniques for extending the length of the launch tube all suffer from the shortcoming that they require manual actions by the soldier in order to prepare the system for missile launch. These actions take time, may be difficult to perform under battlefield conditions, and cannot be performed remotely. There has now been identified a need for an improved approach wherein the missile launch system is both compact and accurate through a sufficiently long launch tube. The present invention fulfills this need, and further provides related advantages.

SUMMARY OF THE INVENTION

The present invention provides a missile and missile launch system that are both compact and achieve high initial launch guidance accuracy. The launch tube is comparable in length with the missile for compact storage, and extends to twice that length during launch. No manual extension action is required by the user of the launch system. As a result, remote launches are possible. The missile attains a self-controllable velocity before exiting the launch tube. The launch tube system of the invention can be readily stored and quickly used.

In accordance with the invention, a telescoping launch tube system for launching a missile comprises an outer case and an inner launch tube internally dimensioned to receive a missile therein and externally dimensioned to slide within the outer case from a rearward position to a forward position. There is further means for releasably holding the inner launch tube at the rearward position, the means being operable to release the inner launch tube upon the firing of the missile, and means for restraining the inner launch tube so that it may not slide past the forward position.

The invention extends to the entire missile system. A missile and missile launching system comprises a missile and a launch system. The launch system includes an outer case and an inner launch tube internally dimensioned to receive the missile therein and externally dimensioned to slide within the outer case from a rearward position to a forward position. The outer case and the inner tube must be controllably restrained, and the inner case and the missile must be controllably restrained. Accordingly, there is means for releasably holding the inner launch tube at the rearward position, the means being operable to release the inner launch tube upon the firing of the missile, means for restraining the inner launch tube so that it may not slide past the forward position, and means for releasably holding the missile at a preselected position within the inner launch tube.

The launcher is about the same length as the missile during storage and up to the point of firing the missile. When the missile propulsion ignites, the missile and inner launch tube separate as a unit from the outer case and slide forwardly along the interior of the outer case, which stays fixed. After the inner launch tube reaches the extent of its permitted travel, the missile separates from the inner launch tube and continues to accelerate along the length of the inner launch tube. As the missile leaves the inner launch tube, it has traveled a distance over twice its own length and has reached a velocity sufficient for its own directional stabilization and control systems to operate.

The present invention provides an advance in the art of tube-launched missile systems. Compact storage and portability are achieved together with excellent initial guidance accuracy using the launch tube. Other features and advantages of the invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
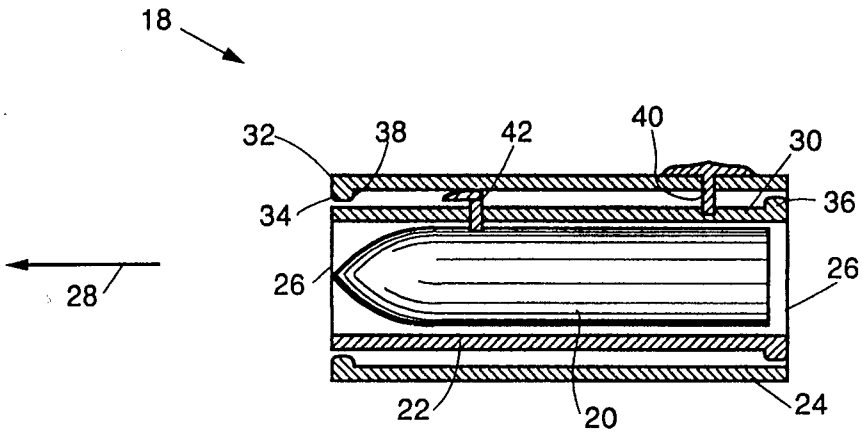
FIG. 1 is a schematic sectional view of the missile launch system and missile prior to initiation of the missile launch.
Figure 2:
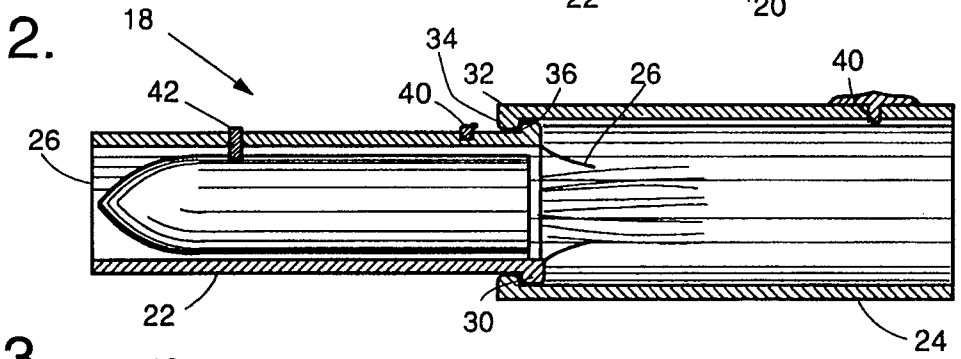
FIG. 2 is a schematic sectional view of the missile launch system and missile at an intermediate stage of the missile launch.
Figure 3:
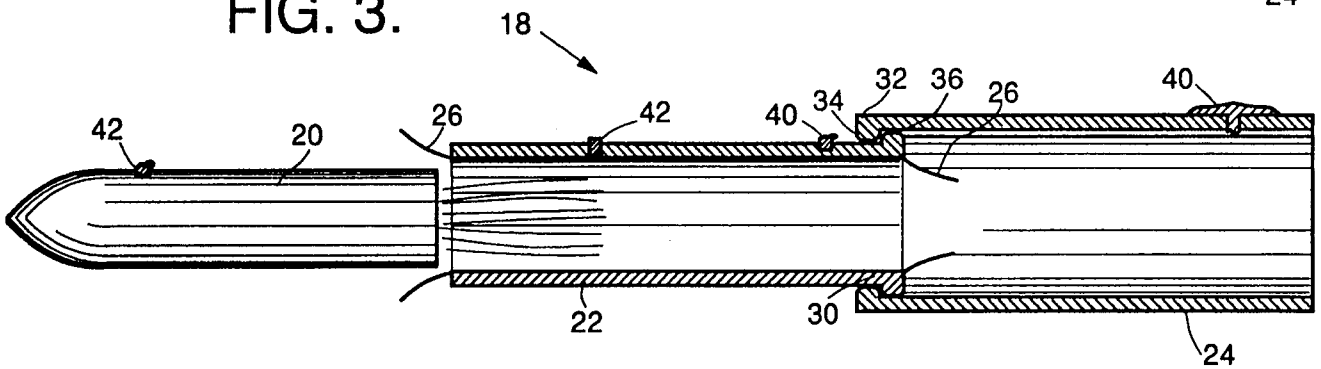
FIG. 3 is a schematic sectional view of the missile launch system and missile after the missile has left the inner launch tube.

The present invention is embodied in a missile and launch tube system 18, which is best understood by reference to a missile launch sequence of FIGS. 1–3. Referring to FIG. 1, prior to launch a missile 20 resides within an inner launch tube 22. The inner launch tube 22 in turn rests within an outer case 24. The inner launch tube 22 and outer case 24 are both substantially cylindrical hollow tubes. The inner launch tube 22 is externally sized to fit within the outer case 24 with a clearance of about 1/32 inch on each side. The inner launch tube 22 is internally sized to receive the missile 20. The inner launch tube 22 and the outer case 24 are of approximately the same length, and both are slightly longer than the missile 20, although there is no restriction as to length.

In a preferred embodiment, the inner launch tube 22 has an internal diameter of about 3-$\frac{1}{8}$ inches and an external diameter of about 3-$\frac{3}{8}$ inches. Both the inner launch tube 22 and the outer case 24 are about 10-$\frac{3}{4}$ inches long. In this preferred embodiment, the outer case 24 is made of graphite-epoxy composite material and the inner launch tube 22 is made from that same material or aluminum alloy. The ends of the inner launch tube 22 and the outer case 24 are sealed with a fly-through seal 26 made of a thin polyamide film bonded to a heavier sheet of polyolefin, which prevents contamination of the missile, the inner launch tube 22, and the interior of the outer case 24 prior to launch.

Figure 4A:
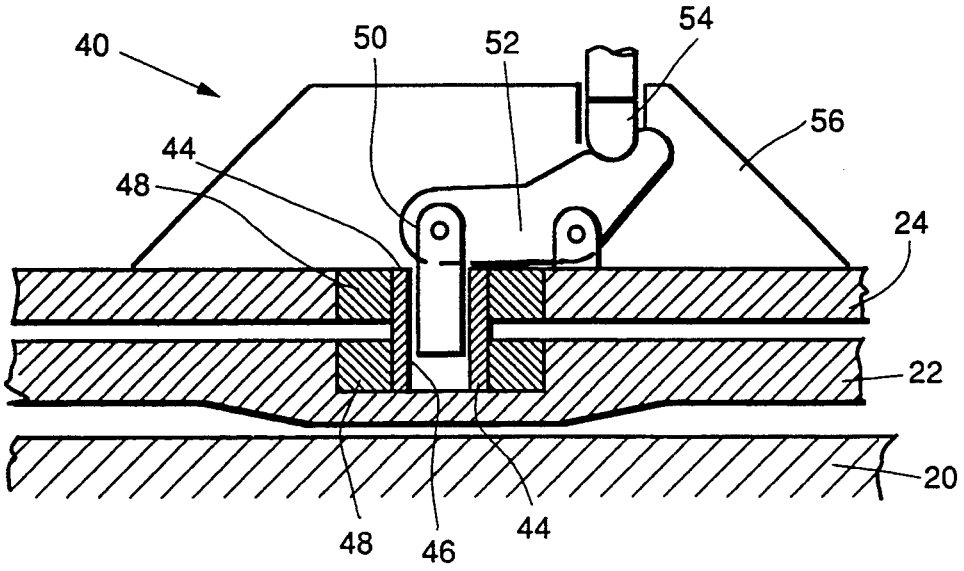
FIG. 4 is a detail of FIG. 1, illustrating the preferred first restraining mechanism used between the outer case and the inner launch tube, in the high-load position (FIG. 4A) and the low-load position (FIG. 4B)
Figure 4B:
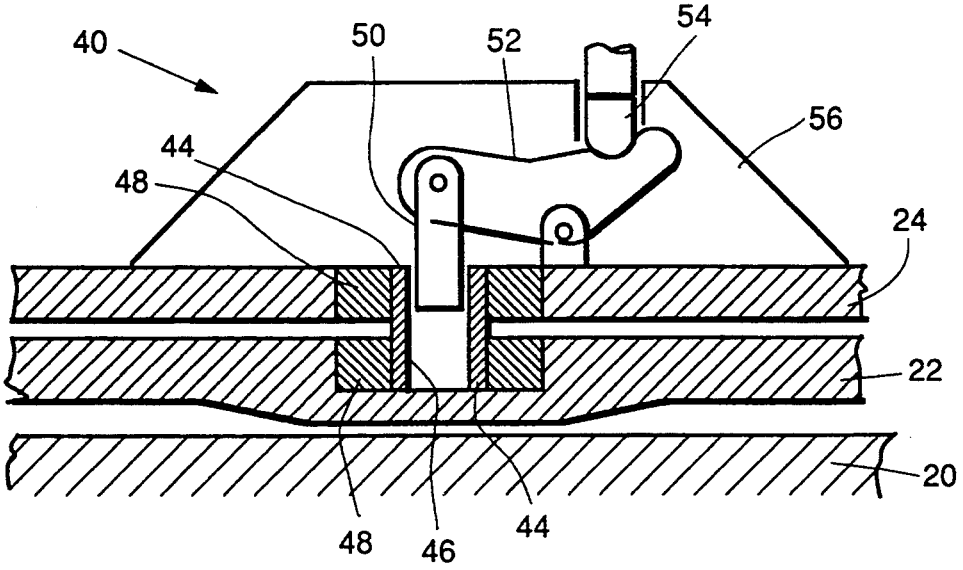

When the propulsion motor of the missile 20 is fired, the missile 20 and the inner launch tube 22 slide as a unit along the bore of the outer case 24 in a forward direction 28. (The manner of restraining undesired relative motion and permitting desired relative motion of the components will be discussed subsequently in relation to FIGS. 4 and 5.) The velocity of the missile 20 increases as it moves forward. Although the missile 20 is not moving relative to the inner launch tube 22, it is moving relative to, and being guided in its path by, the outer case 24. As the missile 20 and inner launch tube 22 move forwardly, they rupture the fly-through seal 26 at the forward end of the launch tube, and the force of the exhaust of the propulsion motor ruptures the fly-through seal at the rearward end of the launch tube.

When a rearward end 30 of the inner launch tube 22 reaches a forward end 32 of the outer case 24, the relative movement of the inner launch tube 22 is halted, as shown in FIG. 2. The forward end 32 of the outer case 24 has an inwardly and rearwardly facing shoulder 34. The rearward end 30 of the inner launch tube 22 has an outwardly and forwardly facing shoulder 35. The two shoulders 34 and 36 are dimensioned to engage each other to halt the forward movement of the inner launch tube 22 with respect to the outer case 24 at this point. To reduce the impact loading as the two shoulders engage, a bumper ring 38 of an elastomer material may be placed between the two shoulders 34 and 36.

Figure 6:
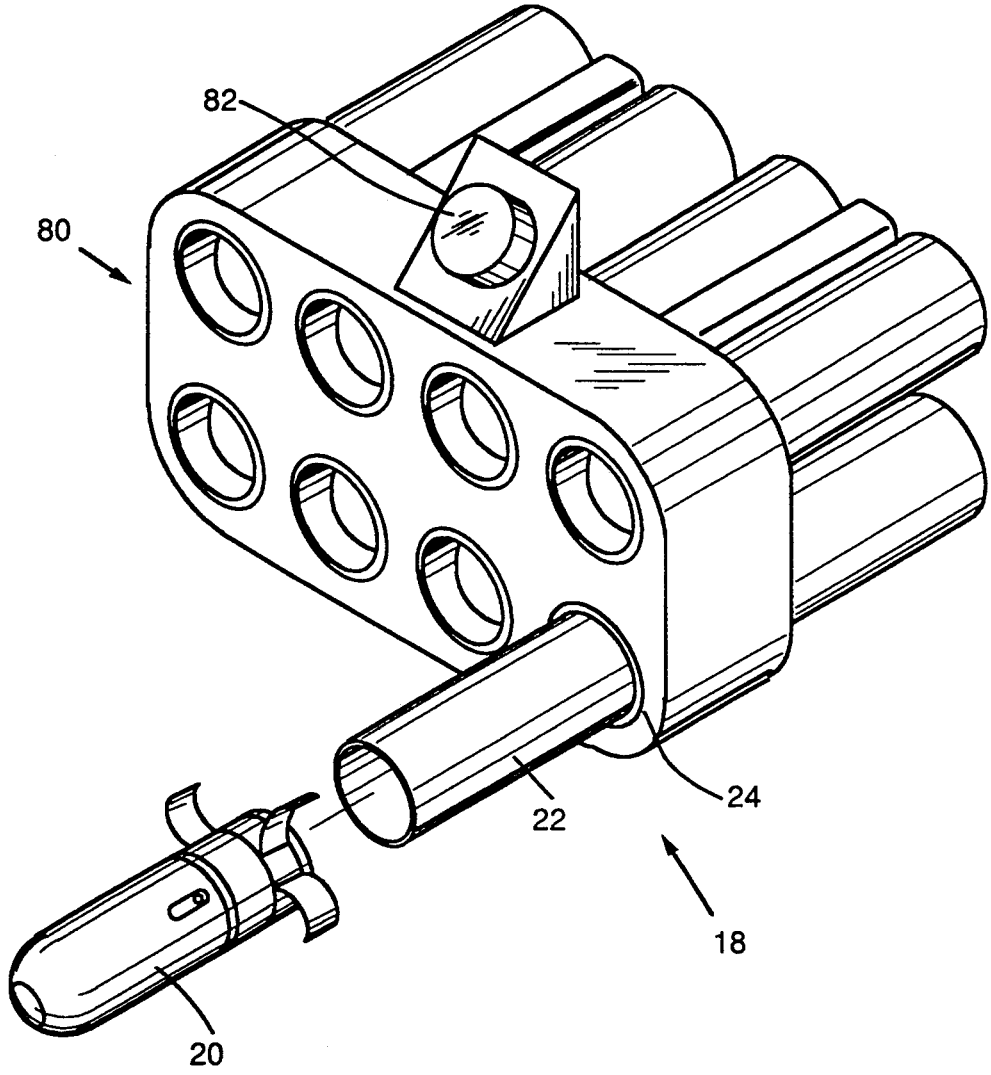
FIG. 6 is a perspective view of a multiple missile launch system using the approach of the invention.

Since it is still powered by its propulsion motor, the missile 20 continues its forward movement and leaves the inner launch tube 22, as shown in FIG. 3. (The control fins of the missile are normally folded against the body of the missile during storage, and deploy by unfolding after launch. The deployment has not yet occurred in the view of FIG. 3, but it has occurred in the view of FIG. 6.) The effective extended length of the launcher is Just slightly less than twice the individual lengths of the outer case 24 and the inner launch tube 22. The missile and launcher system are compact, as shown in FIG. 1, for storage. Yet the missile receives guidance of its trajectory for nearly twice the distance during the launch procedure as compared with a single-length of inner launch tube, as shown in FIGS. 2 and 3. This increased length of guidance has been determined to be highly desirable in a proper initial guidance of the missile toward its target. No manual operation of the operator is required in order to achieve this extended length of the outer case and inner launch tube.

The missile 20, inner launch tube 22, and outer case 24 must be securely restrained prior to launch. This restraint holds the three components together to reduce the potential for damage in the event of mishandling such as dropping the system. This restraint must be released prior to launch. However, the restraint cannot be removed entirely prior to firing of the missile, because the missile 20 might slide out of the inner launch tube 22, or the inner launch tube might slide out of the outer case 24 if all restraint is removed. The outer case 24 must be held fixed relative to the inner launch tube 22 until the missile propulsion is ignited, and then released so that the inner launch tube 22 can slide relative to the outer case 24. Further, the missile 20 must be held fixed relative to the inner launch tube 22 during the initial launch period, but then released after the inner launch tube 22 reaches its forward-most point, as shown in FIG. 2.

In the preferred approach, a first restraining mechanism 40, shown in FIGS. 1–4, is placed between the outer case 24 and the inner launch tube 22. A second restraining mechanism 42, shown in FIGS. 1–3 and 5, is placed between the inner launch tube 22 ! and the missile 20. It is possible to combine these two restraint devices into a single structure. The simplicity in construction and lower cost of using two mechanisms 40 and 42 is preferred.

Referring to FIG. 4, the first restraint mechanism 40 includes a hollow cylindrical shear pin 44 residing in an aligned bore 46 formed through two bushings 48. The two bushings 48 are axially aligned in the wall of the inner launch tube 22 and the wall of the outer case 24. The shear pin 44 extends through the length of the bore 46, bridging across the wall of the inner launch tube 22 and the wall of the outer case 24. A holdback pin 50 slidably resides in the cylindrical hollow interior of the pin 44. The shear pin 44 is preferably made of an aluminum alloy, and the holdback pin 50 is preferably made of steel.;

The holdback pin 50 is pivotably connected to a lever arm 52 in the outer case 24. The lever arm 52 is in turn connected to and operated by a push rod 54 that forms part of an arming mechanism 56 for the missile system 18. In a first position, FIG. 4A, the push rod 54 is withdrawn so that the holdback pin 50 extends entirely through the length of the bore 46. In this position, the inner launch tube 22 and the outer case 24 are firmly locked together by the steel pin 50 so that they cannot move with respect to each other, even when high loadings are applied. This arrangement is used during shipping and storage of the missile system 18, so that even large loadings such as may be applied by accidentally dropping the entire system or during rough rides in a carrier vehicle cannot cause the inner launch tube 22 to disengage from the outer case 24.

When the launch system is readied for launching the missile, the arming mechanism 55 is operated. As part of the arming procedure, the push rod 54 is pushed inwardly, so that the holdback pin 50 is withdrawn to a second position, FIG. 4B such that it does not extend between the walls of the inner launch tube 22 and the outer case 24. In this armed position, only the aluminum shear pin locks the inner launch tube 22 to the outer case 24. The shear pin 44 is sized such that it is sheared by the force generated by the propulsion system of the missile 20. That is, when the rocket motor of the missile 20 is fired, the shear pin is sheared so that the inner launch tube 22 can slide forwardly within the outer case 24. The close fit between the shear pin 44 and the bushings 48 ensures that the shear pin 44 fails in essentially pure shear, a highly predictable phenomenon, rather than the less-predictable shear and bending mode.

If the system were to be dropped or otherwise heavily loaded after arming but before firing, it is possible that the shear pin 44 might be sheared so that the inner launch tube 22 pin 40 could move with respect to the outer case 24. However, this eventuality is believed to be unlikely, since arming normally occurs immediately before firing and there is little chance of such heavy loadings in the intervening period. If, after arming and before firing, a decision is made not to fire the missile, this portion of the arming procedure may be reversed by withdrawing the push rod 54 so that the holdback pin 50 is re-inserted into the interior of the shear pin 44, again locking the inner launch tube 22 to the outer case 24 in the first position, FIG. 4A.

The second restraining mechanism 42 locks the missile 20 to the inner launch tube 22 during storage and handling, FIG. 1. When the missile 20 is fired, it must continue to lock the missile 20 to the inner launch tube as the inner launch tube 22 slides within the outer case 24 until the inner launch tube 22 reaches its full permitted extension, shown in FIG. 2. At that point, the missile 20 must be released so that it is permitted to accelerate out of the inner launch tube 22, as shown in FIG. S.

Figure 5A:
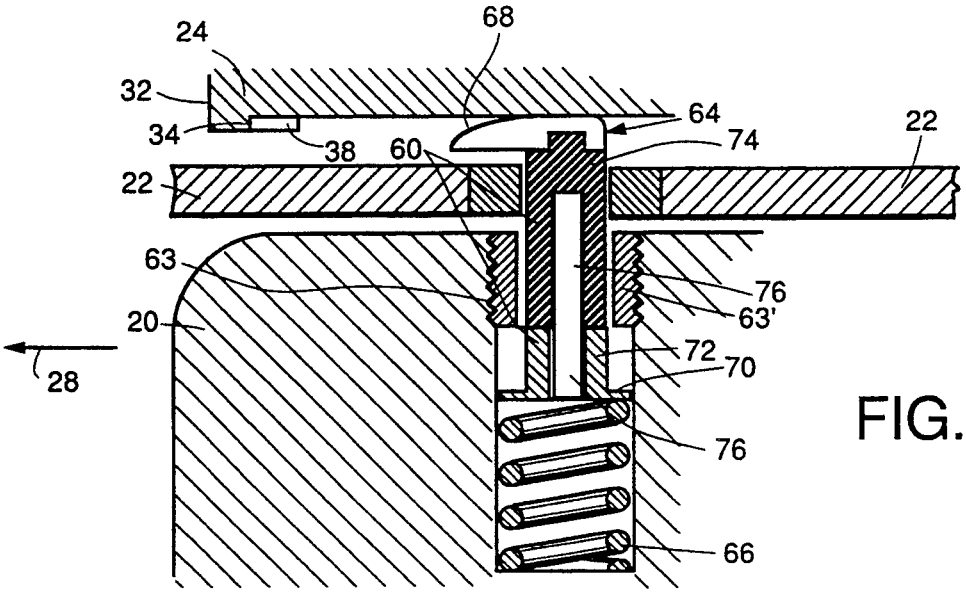
FIG. 5 is a detail of FIG. 1, illustrating the preferred second restraining mechanism used between the inner launch tube and the missile, showing a bore rider within the outer case (FIG. 5A), after the bore rider no longer contacts the outer case (FIG. 5B), and after the missile has separated from the inner launch tube (FIG. 5C)
Figure 5B:
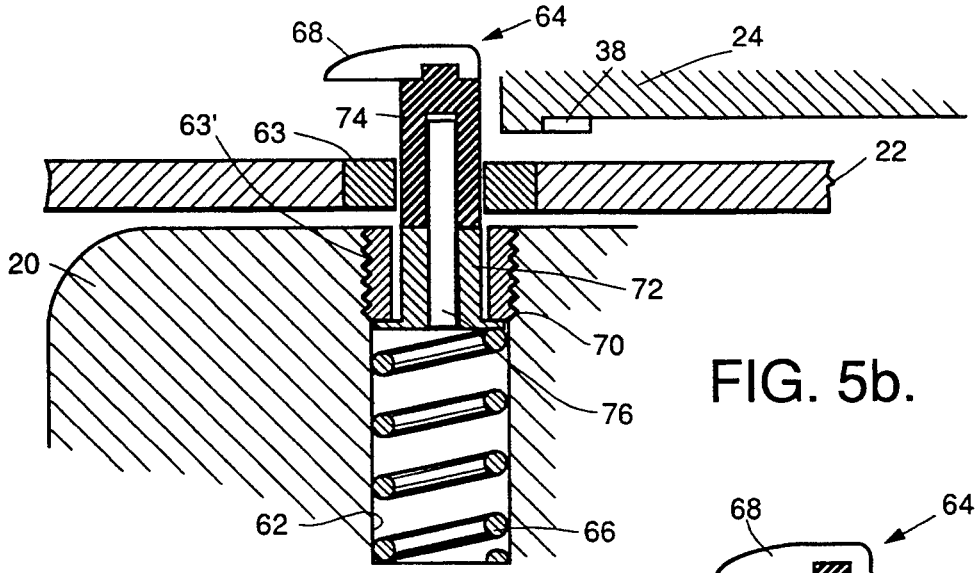
Figure 5C:
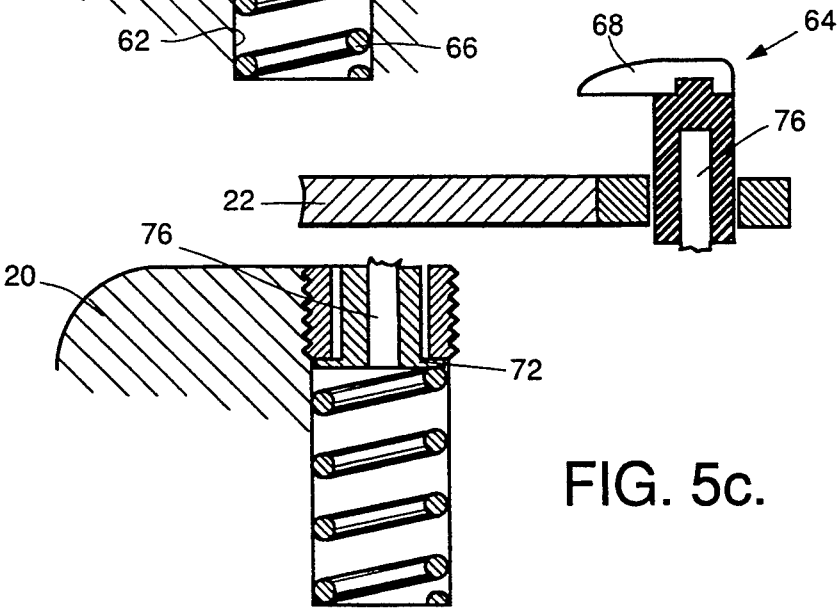

A preferred second restraining mechanism 42 is shown in FIG. 5. This mechanism 42 resides primarily in the body of the missile 20, with a portion extending through the wall of the inner launch tube 22. Referring to FIG. 5A, the mechanism 42 includes a two-part, cylindrical hollow holdback pin 60 that resides within a bore 62 in the missile 20. The bore 62 is defined by bushings 63, 63' in the missile 20 and the wall of the inner launch tube 22. In a first position shown in FIG. 5A, the holdback pin 60 is compressed downwardly by a bore rider 64 against a spring 66 at the bottom of the bore 62. In this position, a solid portion of the holdback pin 60 extends between the missile 20 and the inner launch tube 24, holding them firmly together. The holdback pin 60 is preferably made of steel, and therefore fixes the missile 20 to the inner launch tube 24 firmly against even high shock loadings, in generally the same manner as described previously in relation to the first position of the first restraining mechanism 40.

When tile rocket motor of the missile 20 is fired, the holdback pin 60 remains in the position shown in FIG. 5A. The missile 20 remains locked to the inner launch tube 22 as the inner launch tube slides forwardly in the outer case 24. The bore rider 54, which is preferably made of nylon and has an inwardly tapered leading edge 58, slides along the inner surface of the outer case 24. As the inner launch tube 22 approaches the maximum extent of its permitted travel, the bore rider 54 slides upwardly over the shoulder 94 and the bumper ring 38 at the forward end of the outer case 24. This movement temporarily compresses the spring 66.

Immediately thereafter, the bore rider 64 leaves the outer case 24 and is no longer constrained against outward movement under the biasing force of the spring 66. The bore rider 64 and the attached holdback pin 60 move outwardly to a second position shown in FIG. 5B. The extent of the outward movement of the holdback pin 60 is limited by the contacting of a shoulder 70 on a lower portion 72 of the two-part holdback pin 60 to the bushing 63' located in the missile 20. The position of the shoulder 70 is selected such that, when the limit of movement of the holdback pin 60 is reached, the lower portion 72 of the holdback pin 60 is located in the missile and an upper portion 74 is located in and exterior to the wall of the inner launch tube 22. In this position, the missile 20 and the inner launch tube 22 are no longer locked together by the holdback pin 60.

The upper portion 74 and the lower portion 72 of the holdback pin 60 are connected by a shear pin 76, which is preferably made of aluminum. When the second restraining mechanism 42 is in the first position as shown in FIG. 5A, the shear pin 76 has little loading imposed upon it. Forces transmitted between the missile 20 and the inner launch tube 22 are transmitted through the steel holdback pin 60. However, when the second restraining mechanism 42 is in the second position of FIG. 5B, only the aluminum shear pin 75 carries the loads between the the inner launch tube 22 and the missile 20. With the second restraining mechanism 42 in this second position of FIG. 5B, the inner launch tube 22 slides forwardly within the outer case 24. This period corresponds to the events occurring between the state depicted in FIG. 1 and that depicted in FIG. 2. The shear pin 75 ensures that the missile 20 and the inner launch tube 22 will slide forwardly as a fixed unit.

When the inner launch tube 22 reaches the full forward extent of its movement, FIG. 2, its movement is halted by the engagement of the shoulders 34 and 96, as previously described. The force exerted by the propulsion motor of the missile 20 is applied to the shear pin 76. The shear pin 76 is dimensioned so that this force causes the shear pin to shear, FIG. 5C, releasing the missile 20 from the inner launch tube 22 so that the missile may fly out of the inner launch tube 22 and away on its mission. The tight fit between the shear pin 76 and the interior of the holdback pin 60 ensures that the shear pin 76 will fall in a predictable shear mode, rather than the less-predictable shear plus bending mode, permitting the required dimension of the shear pin to be readily predicted.

The first restraining mechanism 40 and the second restraining mechanism 42 therefore provide the required degrees of interlocking of the inner launch tube 22 to the outer case 24, and the missile 20 to the inner launch tube 22, respectively. The interlocking is rigid during the respective first positions of the mechanisms 40 and 42, to resist against large shock loadings. The interlocking is controllably releasable by shear loadings during the launch sequence of the missile. An important advantage of these mechanisms is that they are entirely mechanical in nature and require no electrical signals or circuitry. They are activated during arming by the single movement of the mechanical push rod 54 in the case of the first restraining mechanism 40, and by the movement of the missile in the case of the second restraining mechanism 42. These mechanisms 40 and 42 provide a reliable approach for accomplishing the required releasable locking functions.

An application of the present invention is shown in FIG. 5. A number of missiles 20 and launcher systems 18 are placed together in a multiple-missile launch array 80. Each missile launcher system is formed of the same components as discussed in relation to FIGS. 1–5 for a single launcher. The multiple-missile launch array 80 is preferably mounted on alight vehicle for local area defense. It is compact, yet can launch missiles with accuracy. The array 80 is pointed at a target, by sight or by using a sensor 82, and the missiles are fired one-at-a-time or in salvos. This approach would not be feasible as a quick-response weapon if the automatic inner launch tube extension feature of the present invention were not available, since an operator would be required to manually extend or attach launch tube sections together prior to the firing of each missile.

The present invention thus provides an advance in the art of tube-launched missile systems, permitting them to be compact yet accurate and without the need to manually assemble an elongated launch tube. Although a particular embodiment of the invention has been described in detail for purposes of illustration, various modifications may be made without departing from the spirit and scope of the invention. Accordingly, the invention is not to be limited except as by the appended claims.

What is claimed is:

1. A telescoping launch tube system for launching a missile, comprising:

an outer case;

an inner launch tube internally dimensioned to receive a missile therein and externally dimensioned to slide within the outer case from a rearward position to a forward position;

means for releasably holding the inner launch tube at the rearward position until firing of the missile frees the inner launch tube to move toward the forward position; and means for restraining the inner launch tube so that it may not slide past the forward position.

2. The launch tube system of claim 1, wherein the means for releasably holding the inner launch tube at the rearward position includes a shear pin sized to shear under the force of the missile firing.

3. The launch tube system of claim 1, further including a fly-through seal over the ends of the outer case and the inner launch tube.

4. The launch tube system of claim 1, wherein the means for releasably holding the inner launch tube includes first pin means operable in a first state for releasably holding the inner tube at the rearward position against loads up to a first inner tube load level and further includes second pin means operable in a second state for releasably holding the inner tube at the rearward position against loads up to a second inner tube load level, the second inner tube load level being less than the first inner tube load level.

5. The launch tube system of claim 1, wherein the means for restraining includes an rearwardly facing shoulder at a forward end of the outer case and a forwardly facing shoulder at a rearward end of the inner launch tube.

6. The launch tube system of claim 5, further including a bumper positioned between the shoulder on tile outer case and the shoulder on the inner launch tube.

7. A telescoping launch tube system for launching a missile, comprising;

an outer case;

an inner launch tube internally dimensioned to receive a missile therein and externally dimensioned to slide within the outer case from a rearward position to a forward position;

means for releasably holding the inner launch tube at the rearward position until firing of the missile free the inner launch tube to move toward the forward position;

means for restraining the inner launch tube so that it may not slide past the forward position; and means releasably connecting the missile to the inner launch tube for joint movement from the rearward position to the forward position.

8. The launch tube system of claim 7, wherein the means for releasably holding the inner launch tube at the rearward position includes a shear pin sized to shear under the force of the missile firing.

9. The launch tube system of claim 7, further including a fly-through seal over the ends of the outer case and the inner launch tube.

10. The launch tube system of claim 7, wherein the means for releasably holding the inner launch tube includes first pin means operable in a first state for releasably holding the inner tube at the rearward position against loads up to a first inner tube load level and further includes second pin means operable in a second state for releasably holding the inner tube at the rearward position against loads up to a second inner tube load level, the second inner tube load level being less than the first inner tube load level.

11. The launch tube system of claim 7, wherein the means for releasably connecting the missile to the inner launch tube includes holding Din means operable in a first state for releasably connecting the missile to the inner launch tube against loads up to a first missile load level and further includes shear pin means operable in a second state for releasably connecting the missile to the inner launch tube against loads up to a second missile load level, the second missile load level being less than the first missile load level.

12. The launch tube system of claim 7, further including a missile positioned within the inner launch tube.

13. The launch tube system of claim 7, wherein the means for restraining includes an rearwardly facing shoulder at a forward end of the outer case and a forwardly facing shoulder at a rearward end of the inner launch tube.

14. The launch tube system of claim 13, further including a bumper positioned between the shoulder on the outer case and the shoulder on the inner launch tube.

15. A missile and missile launching system, comprising:

a missile;

an outer case;

an inner launch tube internally dimensioned to receive the missile therein and externally dimensioned to slide with;in the outer case from a rearward position to a forward position;

means for releasably holding the inner launch tube at the rearward position until firing of the missile frees the inner launch tube to move toward the forward position;

means for restraining the inner launch tube so that it may not slide past the forward position; and means for releasably connecting the missile to the inner launch tube for joint movement from the rearward position to the forward position.

16. The missile and missile launching system of claim 15, wherein the means for releasably holding the inner launch tube at the rearward position includes a shear pin sized to shear under the force of the missile firing.

17. The missile and missile launching system of claim 15, wherein the means for releasably holding the inner launch tube includes first pin means operable in a first state for releasably holding the inner tube at the rearward position against loads up to a first inner tube load level and further includes second pin means operable in a second state for releasably holding the inner tube at the rearward position against loads up to a second inner tube load level, the second inner tube load level being less than the first inner tube load level.

18. The missile and missile launching system of claim 15, wherein the means for releasably connecting the missile to the inner launch tube includes holding pin means operable in a first state for releasably connecting the missile to the inner launch tube against loads up to a first missile load level and further includes shear pin means operable in a second state for releasably connecting the missile to the inner launch tube against loads up to a second missile load level, the second missile load level being less than the first missile load level.

19. The missile and missile launching system of claim 15, wherein the means for restraining includes an rearwardly facing shoulder at a forward end of the outer case and a forwardly facing shoulder at a rearward end of the inner launch tube.

20. The missile and missile launching system of claim 19, further including a bumper positioned between the shoulder on the outer case and the shoulder on the inner launch tube.

* * * * *